US005673565A

United States Patent [19]

Jeong et al.

[11] Patent Number: 5,673,565

[45] Date of Patent: Oct. 7, 1997

[54] DEFROSTING METHOD AND APPARATUS FOR FREEZER-REFRIGERATOR USING GA-FUZZY THEORY

[75] Inventors: Seong-wook Jeong, Suwon; Jae-in Kim, Seoul; Yun-seok Kang, Suwon, all of Rep. of Korea

[73] Assignee: Samsung Electronics Co. Ltd., Suwon, Rep. of Korea

[21] Appl. No.: 531,088

[22] Filed: Sep. 20, 1995

[30] Foreign Application Priority Data

Nov. 30, 1994 [KR] Rep. of Korea ..... 94-32120

[51] Int. Cl.[6] ..... F25D 21/06

[52] U.S. Cl. ..... 62/80; 62/152; 62/156

[58] Field of Search ..... 62/80, 155, 153, 62/156, 234, 152

[56] References Cited

U.S. PATENT DOCUMENTS

| | | | |
|---|---|---|---|
| 3,005,319 | 10/1961 | Buchanan | 62/153 X |
| 4,297,852 | 11/1981 | Brooks | 62/153 |
| 4,327,557 | 5/1982 | Clarke et al. | 62/153 |
| 4,481,785 | 11/1984 | Tershak et al. | 62/153 |
| 4,959,968 | 10/1990 | Fukuda | 62/156 X |
| 5,379,608 | 1/1995 | Ishimaru et al. | 62/156 X |
| 5,493,867 | 2/1996 | Szynal et al. | 62/80 |

*Primary Examiner*—Harry B. Tanner

*Attorney, Agent, or Firm*—Burns, Doane, Swecker & Mathis LLP

[57] ABSTRACT

There are described a defrosting method and apparatus for a freezer-refrigerator using a GA-fuzzy theory.

A defrosting method for a freezer-refrigerator using a GA-fuzzy theory of the present invention comprises the step of: inputting reference learning data by experiment and actual data to a microcomputer; calculating each frost-quantity on evaporators for a freezing room and a cold-storage room from the input data; inferring each defrosting period for the freezing room and cold-storage room from each frost-quantity on the evaporators for the freezing room and cold-storage room by using a GA-fuzzy theory so that the defrosting periods can be synchronized with each other; and controlling a defrosting heater depending on each defrosting period.

According to the present invention, a freezer-refrigerator can be defrosted by calculating each defrosting period of the freezing room and cold-storage room with precision and accuracy even at an input function which has many inflexion points and is impossible to differentiate, which is different from the conventional defrosting method using the crisp's logical algorithm consisting of '0' and '1'.

11 Claims, 6 Drawing Sheets

$$A1' = 0.5+(|x-p1|-|x-p2|) / 2(p1-p2)$$

$$A2' = 0.5+(|x-p3|-|x-p4|) / 2(p3-p4)$$

DEFROSTING METHOD AND APPARATUS FOR FREEZER-REFRIGERATOR USING GA-FUZZY THEORY

BACKGROUND OF THE INVENTION

The present invention relates to a defrosting method and apparatus for a freezer-refrigerator, more particularly, to a defrosting method and apparatus for a freezer-refrigerator using a genetic algorithm (hereinafter, referred to as GA)-fuzzy theory.

The term, GA-fuzzy theory is a compound word of GA and the fuzzy theory. GA is an algorithm for continuously inferring an unknown correlative function suitable for a type Of input data, to which a procedure of reproduction, hybridization or mutant in an ecosystem is applied. The fuzzy theory is for overcoming limitations of the crisp's logic consisting of '0' and '1', and has been developed itself with variety. The pivot of the fuzzy theory is an inference method using a conditional function. The fuzzy inference method based on the modus ponens theory of Zadeh, a mathematician and founder of the fuzzy theory, infers an output for an input from the outside. Currently, there are widely used three kinds of fuzzy inference methods, that is, a direct inference method, an indirect inference method and a mixed inference method. Each inference method has an operation method for effecting an inference procedure of each inference method efficiently.

The direct inference method includes a max-min operation method and a max-dot operation method. The indirect inference method uses an operation method that a function belonging to a conclusion of each rule is included in an inferrer as a type of a monotonically increasing function. The mixed inference method uses an operation method that an objective function of the set rules are simplified to a linear equation or a constant value, thereby directly inferring by a numerical calculation method.

FIG. 1 is a side sectional view of a common freezer-refrigerator. In FIG. 1, the left side represents the front of the freezer-refrigerator and the right side represents the rear thereof. As shown in FIG. 1, the inside of a body 20 is separated into an upper and a lower parts by a middle wall member 21, to which a freezing room 22 and a cold-storage room 24 for storing food are provided, respectively. Doors 22*a* and 24*a* are mounted to the front surface of body 20 for opening and shutting freezing room 22 and cold-storage room 24. A first evaporator 26 is mounted to the rear part of freezing room 22 for converting supplied air to cold air. A freezing room fan 30 rotating depending on driving of a first fan motor 28 is mounted above first evaporator 26 for circulating the cold air to freezing room 22. A first duct member 32 is mounted to the left of first evaporator 26 for guiding the cold air to flow into freezing room 22. A cold air outlet 32*a* is provided above first duct member 32 at the front of the fan 30 for flowing the cold air into freezing room 22 along first duct member 32. A first heater 33 for removing frost accumulated in first evaporator 26 and an evaporative water container 34 for collecting water generated when the air is cooled are mounted below first evaporator 26. The water collected in evaporative water container 34 is drained to an evaporation dish 54 mounted in the lower part of body 20 via a drain pipe 52 embedded in the rear wall of body 20. A thermistor 36 for sensing inner temperature of freezing room 22 is mounted on the ceiling of freezing room 22. A second evaporator 40 for converting supplied air to cold air is mounted in the rear part of cold-storage room 24. A cold-storage room fan 44 rotating depending on driving of a second motor fan 42 is mounted above second evaporator 40 for circulating the cold air into cold-storage room 24. A second duct member 46 is mounted to the left of second evaporator 40 for guiding the cold air to flow into cold-storage room 24. A cold air outlets 46*a* are mounted to second duct member 46 for flowing the cold air into cold-storage room 24 along second duct member 46. A second heater 47 for removing frost accumulated in second evaporator 40 and an evaporative water container 48 for collecting water generated when the air is cooled are mounted below second evaporator 40. A thermistor 50 for sensing inner temperature of cold-storage room 24 is mounted on the left side of second duct member 46. A compressor 56 is mounted to the rear lower part of body 20 for compressing low-temperature and low-pressure gaseous refrigerant cooled in second evaporator 40 into a high-temperature and high-pressure gaseous state. A main condenser 58 is embedded in the rear wall of body 20 for converting the high-temperature and high-pressure gaseous refrigerant compressed in compressor 56 into a low-temperature and high-pressure liquid refrigerant. Plural shelf members 62 are mounted inside freezing room 22 and cold-storage room 24 for supporting food.

FIG. 2 is a flow chart showing a conventional defrosting method of a freezer-refrigerator.

First, reference data such as an operation time of a compressor and each temperature of a freezing room and a cold-storage room are input. If an actual operation time of the compressor is longer than the operation time of the reference data, each temperature of the freezing room and the cold-storage room are measured to be compared with each temperature of the reference data. If the temperature of the freezing room or the cold-storage room drops less than the reference temperature, a freezing room heater or a cold-storage room heater operates. If the temperature of the freezing room or the cold-storage room is greater than the reference temperature after operating the heater, the freezing room heater or the cold-storage room heater stops operating. Therefore, the conventional defrosting method of a freezer-refrigerator has limitations on precision and accuracy in the case of an input function which has many inflexion points and is impossible to differentiate because a microcomputer is programmed by using a crisp's logical algorithm consisting of '0' and '1'. Up to now, there have been many problems in that the defrosting periods of the freezer-refrigerator having not less than two evaporators are not easily synchronized with each other due to the input variables changing at any time. That is, the unsynchronized defrosting periods of the freezing room and the cold-storage room cause a low efficiency of freezing/refrigerating function and an increase of the electrical consumption.

SUMMARY OF THE INVENTION

An object of the present invention is to provide a defrosting method and apparatus for a freezer-refrigerator using a GA-fuzzy theory which can overcome limitations of the prior art.

To achieve the above object, there is provided a defrosting method for a freezer-refrigerator according to the present invention comprising the steps of: inputting reference learning data by experiment and actual data to a microcomputer; calculating each frost-quantity on evaporators for a freezing room and a cold-storage room from the input data; inferring each defrosting period for the freezing room and cold-storage room from the frost-quantities on the evaporators for the freezing room and cold-storage room by using the GA-fuzzy theory so that the defrosting periods are synchronized with each other as much as possible; and controlling a defrosting heater by each defrosting period.

To achieve the above object, there is provided a defrosting apparatus for a freezer-refrigerator of the present invention comprising: means for inputting reference learning data by experiment and actual data; a microcomputer for calculating frost-quantities on evaporators from the input data to infer a defrosting period by using the GA-fuzzy theory; and means for controlling a defrosting heater depending on the inferred defrosting period.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION

Figure 1:
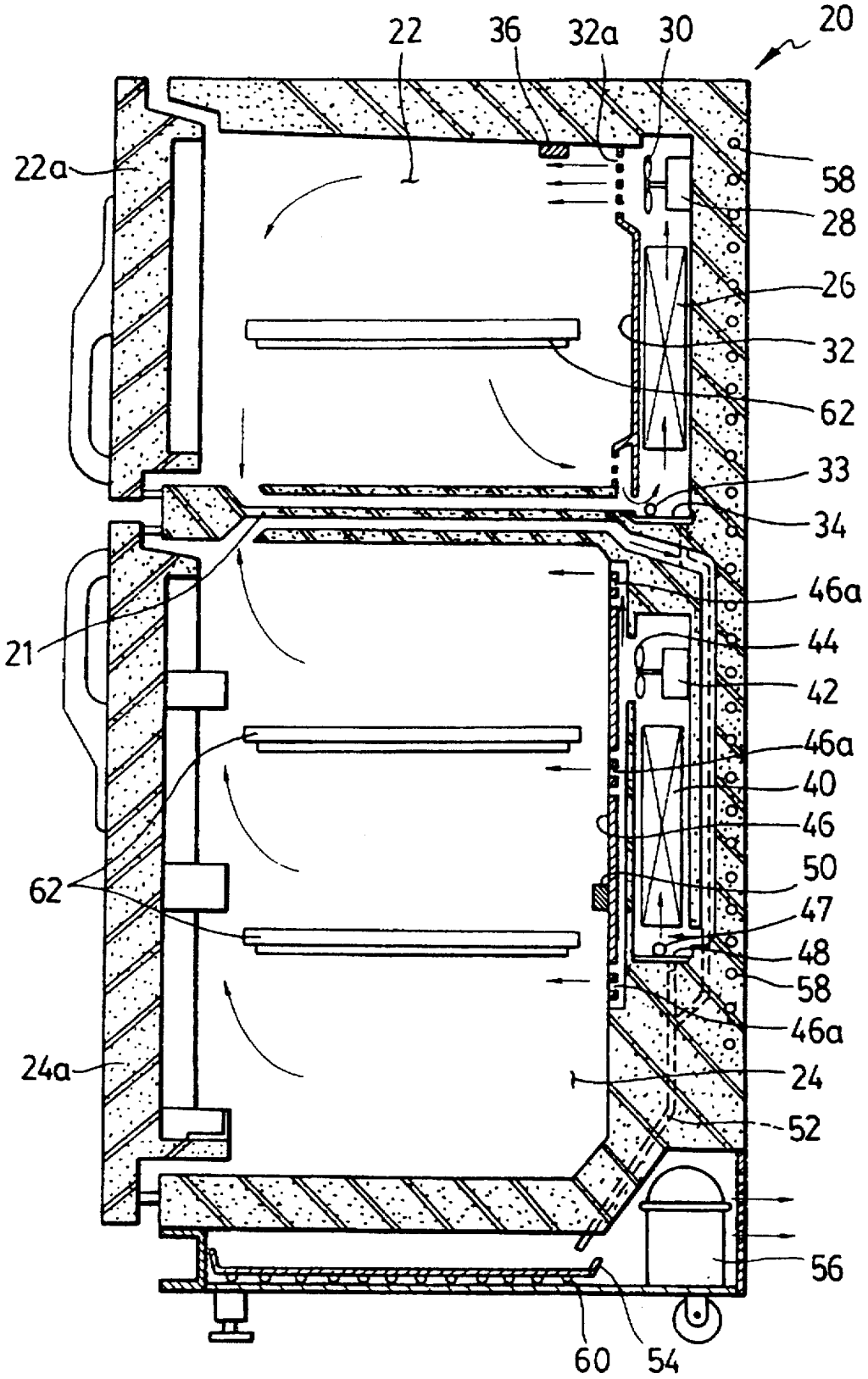
FIG. 1 is a side sectional view of a common freezer-refrigerator.
Figure 2:
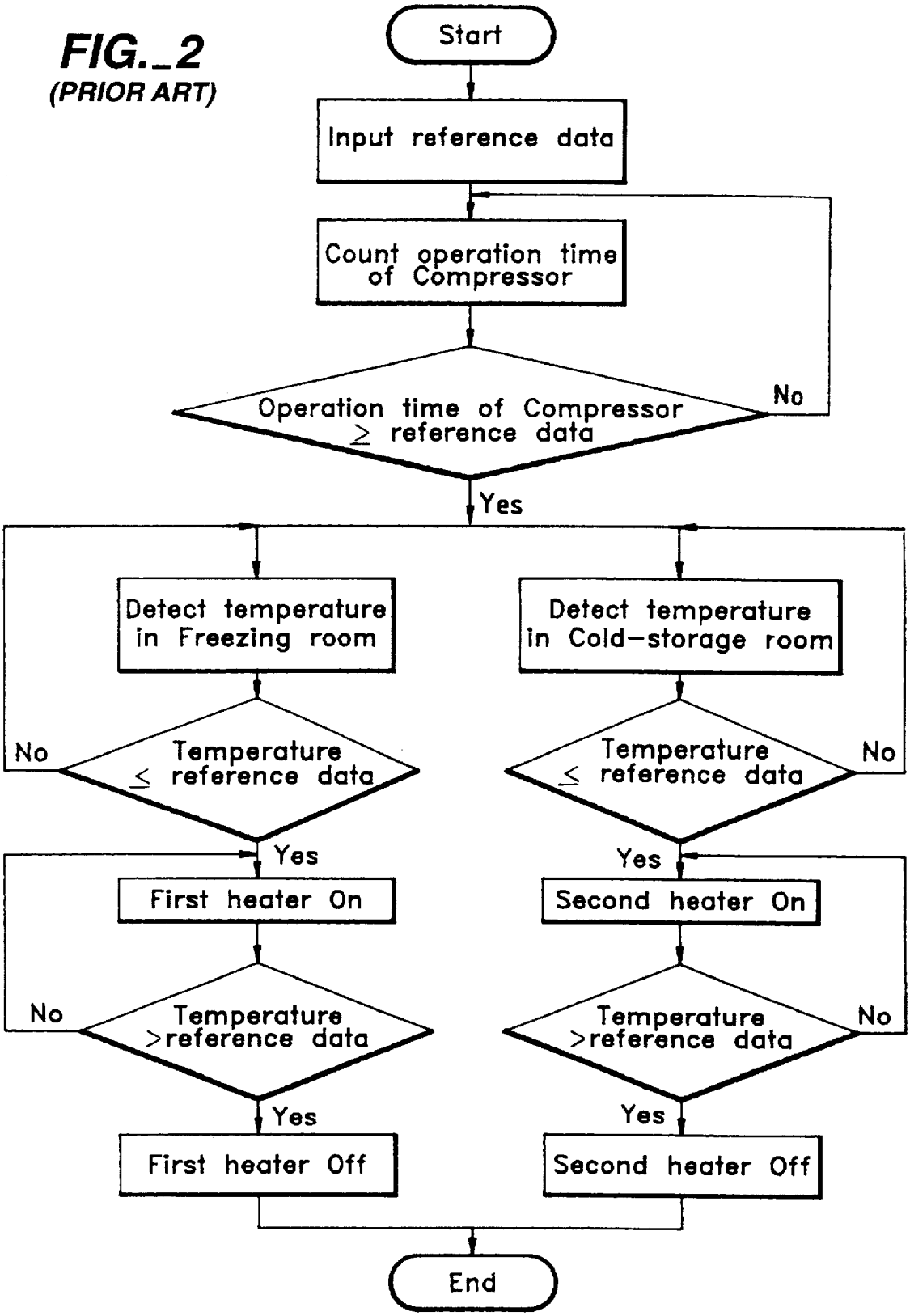
FIG. 2 (PRIOR ART)
FIG. 2 is a flow chart showing a conventional defrosting method for a freezer-refrigerator.
Figure 3:
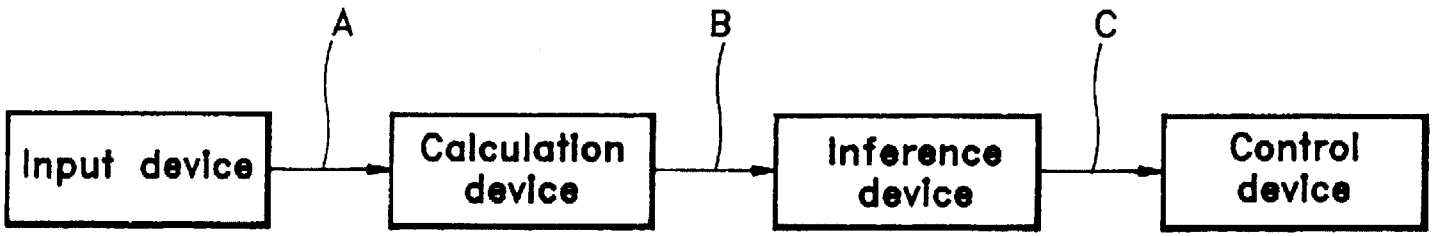
FIG. 3 is a block diagram roughly showing a characteristic of the present invention.

FIG. 3 is a block diagram roughly showing a characteristic of the present invention. In FIG. 3, the input device outputs the actual environment data (A). The calculation device calculates each frost-quantity (B) on the evaporators of a freezing room and a cold-storage room from the actual environment data (A). The inference device infers and determines each defrosting period (C) by using the GA-fuzzy theory so that said defrosting periods are synchronized with each other as much as possible for increasing the efficiency of the freezing/refrigerating function and for reducing unnecessary energy consumption. The control device controls a defrosting heater by each determined defrosting period (C). Actually, the calculation device and inference device are included in a microcomputer running an executive program.

Figure 4:
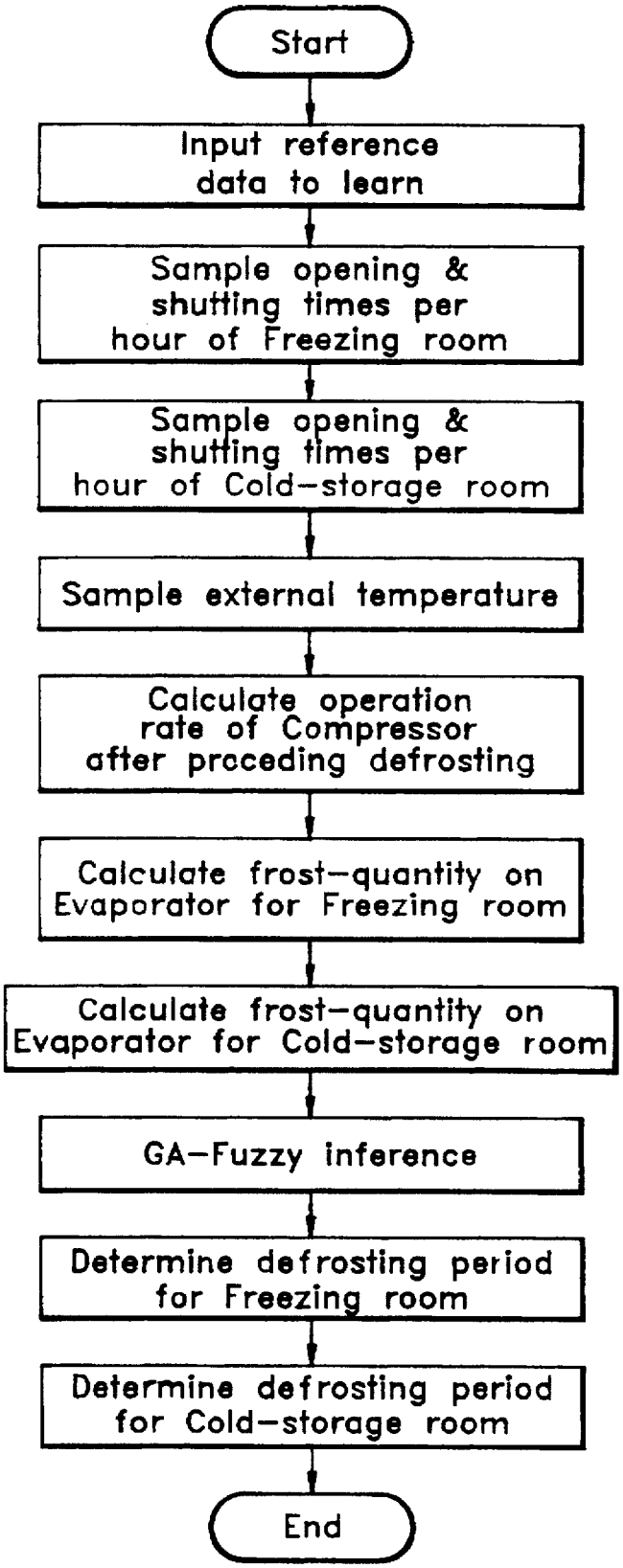
FIG. 4 is a flow chart showing a defrosting method for a freezer-refrigerator according to one embodiment of the present invention.

FIG. 4 is a flowchart showing a defrosting method for a freezer-refrigerator according to one embodiment of the present invention. In the first step, the user inputs reference learning data of frost-quantities to environmental conditions on the evaporators of the freezing room and cold-storage room by experiment to the microcomputer. Next, the input device (in FIG. 3) samples the number of opening and shutting times per hour of the freezing room. Also, the input device (in FIG. 3) samples the number of opening and shutting times per hour of the cold-storage room. After that, the input device (in FIG. 3) samples the external temperature. Then, the microcomputer calculates the operation rate of the compressor after defrosting. In a 6th step, the microcomputer calculates the frost-quantity (B in FIG. 3) on the evaporator for freezing room. Then, the microcomputer calculates the frost-quantity (B in FIG. 3) on the evaporator for cold-storage room. After that, the microcomputer infers each defrosting period (C in FIG. 3) by using the GA-fuzzy theory so that said defrosting periods are synchronized with each other as much as possible for increasing the efficiency of the freezing/refrigerating function and for reducing unnecessary energy consumption. Then, the microcomputer determines the defrosting period (C in FIG. 3) for the freezing room. In a 9th step, the microcomputer determines the defrosting period (C in FIG. 3) for cold-storage room. Finally, the control device (in FIG. 3) controls the defrosting heater by each determined defrosting period (C in FIG. 3).

Figure 5:
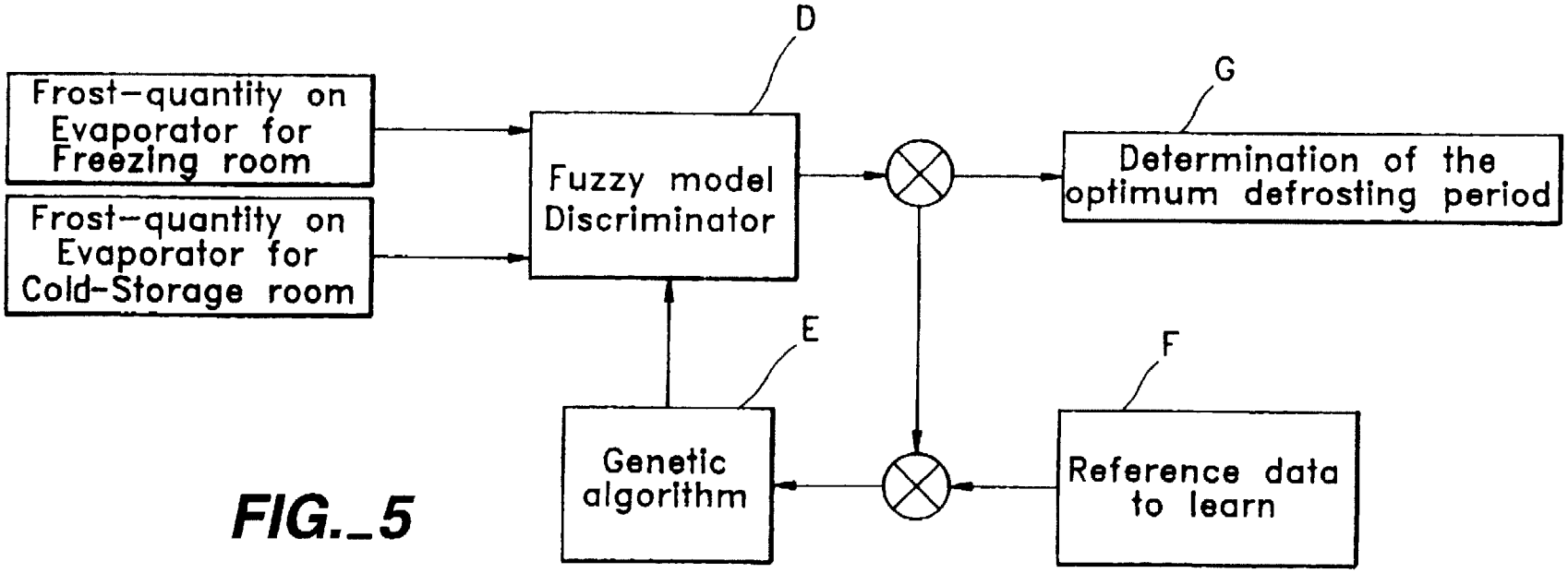
FIG. 5 is a block diagram showing a process for applying a GA-fuzzy inference to one embodiment of the present invention according to the flow chart as shown in FIG. 4.

FIG. 5 is a block diagram showing a process for applying a GA-fuzzy inference to one embodiment of the present invention according to the flow chart as shown in FIG. 4. The process for applying the GA-fuzzy theory in FIG. 5 is carried out by being programmed to the microcomputer.

The GA-fuzzy algorithm of the present invention can be represented as conditional functions comprising premise parts and conclusion parts. The fuzzy model, i.e., each frost-quantity on the evaporators of a freezing room and a cold-storage room, vary depending on the minute variations of the input data. Thus, the fuzzy model discriminator (D) is a fuzzy membership function that acquires optimal data of two input variables.

The GA(E) is an algorithm running conditional functions. The premise parts are conditions of said two input variables. The conclusion parts are relative formulas between optimum defrosting period and each of said input variables. Said relative formulas are set so that the defrosting periods for the freezing room and cold-storage room are synchronized with each other as much as possible for increasing the efficiency of the freezing/refrigerating function and for reducing unnecessary energy consumption. The premise parts can be set by many experiments. The reference learning data (F) is inputted to GA(E) and forms the premise parts. After running the GA (E), each optimal defrosting period for the freezing room and cold-storage room can be determined (G) continuously.

The fuzzy rules can be represented as a conditional function as follows:

| | | |
|---|---|---|
| If | $x_1$ is $A_{1i}$, $x_2$ is $A_{2i}$ . . . $x_m$ is $A_{mi}$, | premise |
| then | $y_1 = a_{0i} + a_{1i}x_1 \ldots + a_{mi}x_m$. | conclusion |

Here, $x_i$ through $x_m$ are input variables, $A_{1i}$ through $A_{mi}$ are condition parameters of the ith premise, $y_i$ is ith objective function, and $a_{0i}$ through $a_{mi}$ are parameters of the ith conclusion.

This conditional function becomes the ith fuzzy rules used in GA (E) in FIG. 5.

Generally, in order to set a fuzzy model, a setting of the structure and parameters of the premise and a setting of the structure and parameters of the conclusion are performed. In this conditional function, $x_i$ through $x_m$ correspond to the structures of the premise and the conclusion. The condition $A_{1i}$ through $A_{mi}$ of the premise are set by performing many experiments and using a genetic algorithm. Thus, the data of condition parameters $A_{1i}$ through $A_{mi}$ of the premise are set by inputting the reference learning data (F) by experiment. The fuzzy model discriminator (D) determines the optimal data of input variables $x_1$ through $x_m$. And the, GA (E) infers the objective function $y_i$ of the conclusion by using a mixed inference method and determines the optimal defrosting periods for each of the freezing room and cold-storage room continuously.

Figure 6:
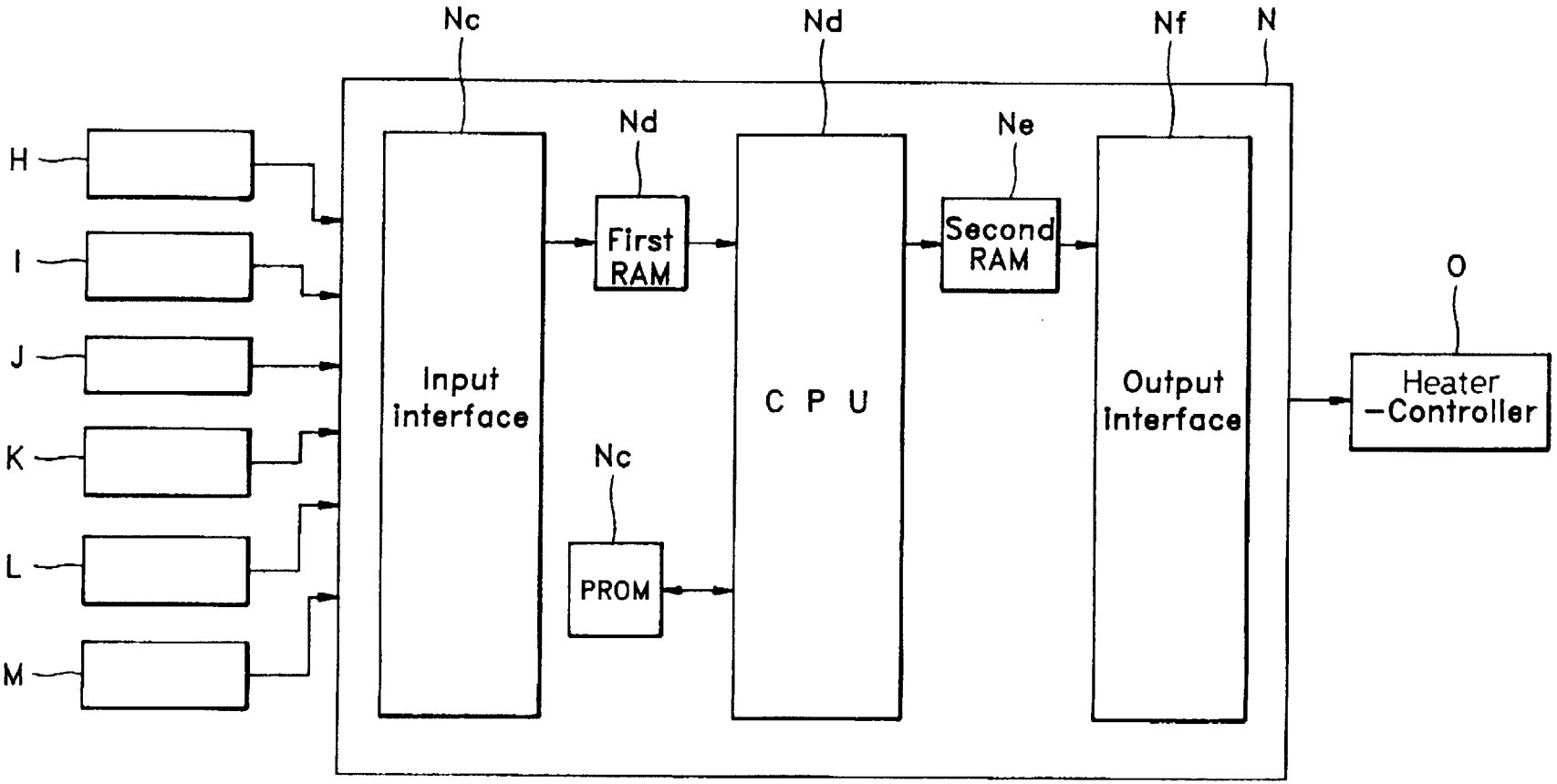
FIG. 6 is a control block diagram for realizing a defrosting apparatus for a freezer-refrigerator according to one embodiment of the present invention.

FIG. 6 is a control block diagram for realizing a defrosting apparatus for a freezer-refrigerator according to one embodiment of the present invention. If the microcomputer is programmed by using the algorithm as described above, the defrosting apparatus of a freezer-refrigerator using GA-fuzzy theory is realized as shown in FIG. 6. A microcomputer (N) which is a pivot of the present invention comprises: an input interface unit ($N_c$) for controlling actual data output from input units (H, T, . . . , M) according to a specification of a subsequent circuit; a first random access memory (RAM) unit ($N_b$) for storing the data controlled at the input interface unit; a programmable read only memory (PROM) unit ($N_c$) for storing reference learning data and an executive program; CPU ($N_d$) for running the data and the program of the first RAM unit and the PROM unit to infer optimal defrosting periods of a freezing room and a cold-storage room, respectively; a second RAM unit ($N_e$) for storing the inferred output for a while; and an output interface unit ($N_f$) for controlling the data of the second RAM unit ($N_e$) so as to be fitted to a specification of a heater controller. Here, the reference learning data, a calculation program for obtaining the defrosting periods of a freezing room and a cold-storage room and a GA-fuzzy inference program are stored in the PROM unit ($N_c$). CPU ($N_d$) runs the calculation program stored in PROM unit ($N_c$) to obtain each frost-quantity of the freezing room and cold-storage room, and thereafter runs the GA-fuzzy inference program by using each frost-quantity as input variables. An objective function inferred from CPU ($N_d$), that is, each optimal defrosting period data of the freezing room and cold-storage room is input to a heater-controller (O) via second RAM unit ($N_e$) and output interface unit ($N_f$).

Figure 7:
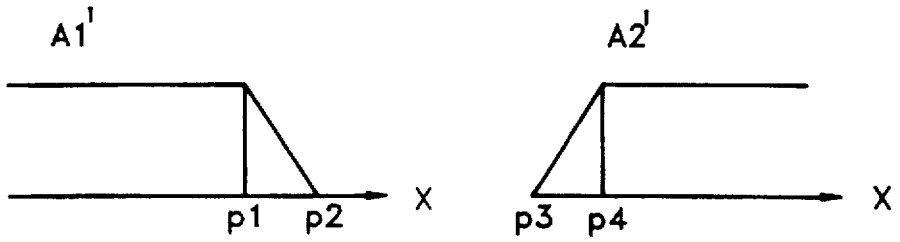
FIG. 7 is an example for calculating parameters of a premise using a genetic algorithm (GA)

There is described a method for obtaining said condition parameters $A_{1i}$ and $A_{2i}$ of the premise using the GA in FIG. 7, where x is data of each input variable set in fuzzy model discriminator (D in FIG. 5) and $p_1$ through $p_m$ each are constants for each input variable (x) based on reference learning data (F in FIG. 5) by many experiments. That is, when ith input data x satisfies the right side of the equation described in the lower part of FIG. 7, the premise of said conditional function is set. The reference learning data (F in FIG. 5) means the resultant data corresponding to the number of cases according to a data combination of the input variables by experiment. In the case of the embodiment of the present invention, the reference learning data (F in FIG. 5) is the relative frost-quantities to environmental conditions on the evaporators of the freezing room and the cold-storage room by experiment. And said condition parameters of the premise are two parameters of $A_{1i}$ and $A_{2i}$.

Figure 8:
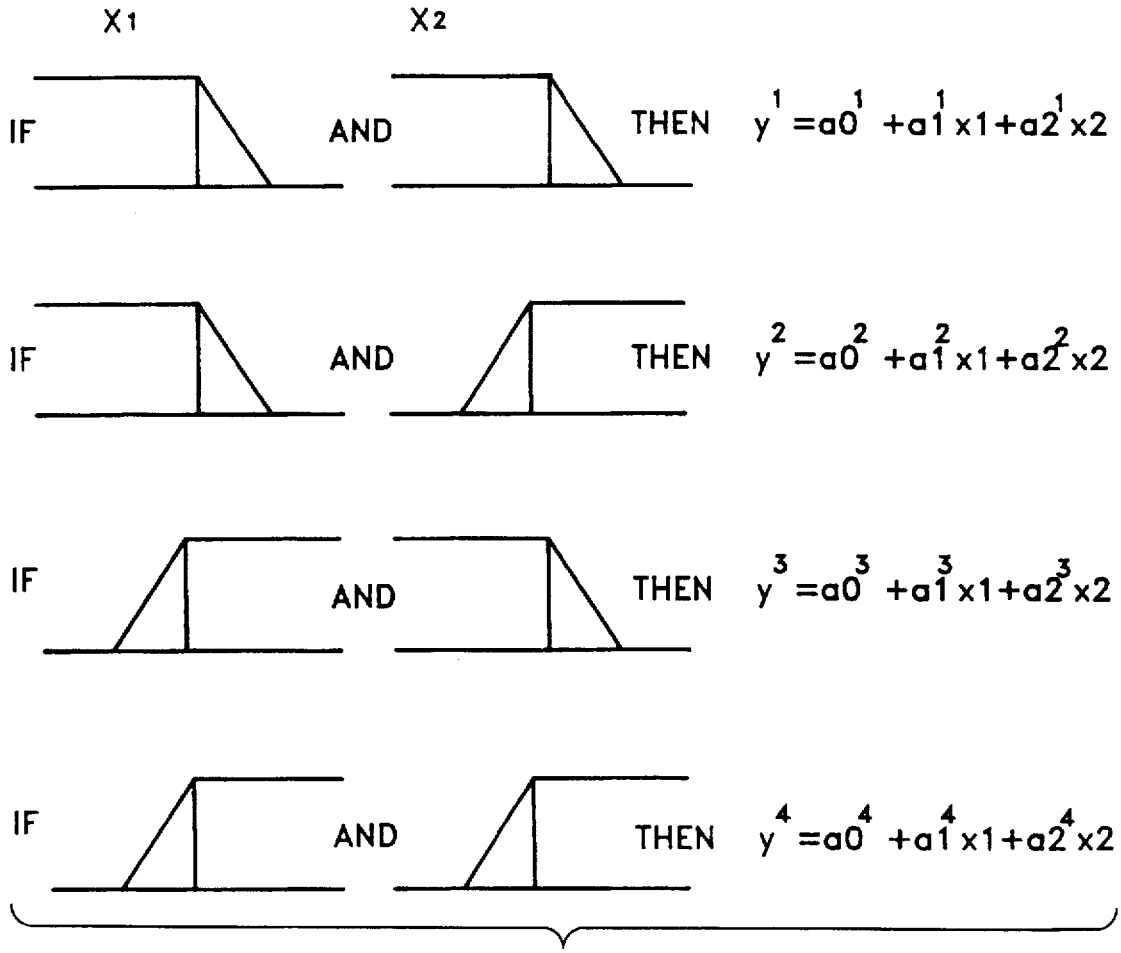
FIG. 8 is an example of a fuzzy inference method for inferring an objective function.

When the condition parameters $A_{1i}$ and $A_{2i}$ of the premise are set, GA (E in FIG. 5) infers the ith objective function $y_i$ by the algorithm as shown in FIG. 8 according to the mixed fuzzy inference method (TSK method). FIG. 8 is a diagram representing the case having two input variables $x_1$ and $x_2$, i.e., each discriminated frost-quantity on the evaporators of a freezing room and a cold-storage room from the fuzzy model discriminator (D in FIG. 5). The fuzzy rule therefor is represented as follows:

| | | |
|---|---|---|
| If | $x_1$ is $A_{11}$, $x_2$ is $A_{11}$, | premise |
| then | $y_1 = a_{01} + a_{1i}x_1 + a_{21}x_1$. | conclusion |
| If | $x_1$ is $A_{11}$, $x_2$ is $A_{21}$, | premise |
| then | $y_2 = a_{02} + a_{12}x_1 + a_{22}x_2$. | conclusion |
| If | $x_1$ is $A_{21}$, $x_2$ is $A_{11}$, | premise |
| then | $y_3 = a_{03} + a_{13}x_1 + a_{23}x_2$. | conclusion |
| If | $x_1$ is $A_{21}$, $x_2$ is $A_{21}$, | premise |
| then | $y_4 = a_{04} + a_{14}x_1 + a_{24}x_2$. | conclusion |

Here, $x_1$ is the input variable of the frost-quantity on the evaporator of the freezing room, $x_2$ is the input variable of the frost-quantity on the evaporator of the cold-storage room, $A_{11}$ through $A_{21}$ are condition parameters of the premise by experiment, and $a_{01}$ through $a_{24}$ are parameters of the conclusions by experiment.

In FIG. 5, the fuzzy model discriminator (D) determines two types of input variables $x_1$ and $x_2$. GA (E) obtains the parameters $A_{11}$ and $A_{21}$ of the premise by the method described above, and obtains parameters $a_{01}$ through $a_{24}$ of the conclusion from the obtained $A_{11}$ and $A_{21}$, to thereby infer the objective function (i.e., each defrosting period of the freezing room and cold storage room).

According to the present invention, a freezer-refrigerator can be defrosted by calculating each defrosting period of a freezing room and a cold-storage room with precision and accuracy even at an input function which has many inflection points and is impossible to differentiate, which is different form the conventional defrosting method using the crisp's logical algorithm consisting of '0' and '1 '.

What is claimed is:

1. A defrosting method for a freezer-refrigerator using a GA-fuzzy theory comprising the steps of:

acquiring experimentally predetermined reference learning data of frost-quantities to environmental conditions on evaporators of a freezing room and a cold-storage room;

storing said acquired reference learning data to a microcomputer;

measuring the actual environment data of frost-quantifies to environmental conditions on evaporators of a freezing room and a cold-storage room;

inputting said actual environment data to said microcomputer;

calculating each frost-quantity on evaporators of a freezing room and a cold-storage room from said actual environment data by said microcomputer;

inferring and determining each defrosting period for the freezing room and cold-storage room from said acquired reference learning data and said calculated frost-quantities by said microcomputer using the GA-fuzzy theory so that said defrosting periods are synchronized with each other as much as possible; and controlling a defrosting heater by each determined defrosting period.

2. A defrosting method for a freezer-refrigerator using a GA-fuzzy theory as claimed in claim 1, wherein a mixed inference (TSK) method is applied to said GA-fuzzy theory as a fuzzy inference method.

3. A defrosting method for a freezer-refrigerator using a GA-fuzzy theory as claimed in claim 2, wherein the genetic algorithm is applied for setting parameters of the premise of said mixed inference method.

4. A defrosting method for a freezer-refrigerator using a GA-fuzzy theory as claimed in claim 1, wherein said actual environmental data include the number of opening/shutting doors of the freezing room and cold-storage room per hour, outside temperature, operation rate of a compressor, and time periods during the doors of the freezing room and cold-storage room remain opened.

5. A defrosting apparatus for a freezer-refrigerator using a GA-fuzzy theory comprising:

a means for inputting actual environment data of frost-quantities on evaporators of a freezing room and a cold-storage room;

a microcomputer for inferring and determining each a defrosting period for said freezing room and cold-storage room from a reference learning data and said frost-quantities by using the GA-fuzzy theory; and means for controlling a defrosting heater depending on said determined defrosting period.

6. A defrosting apparatus for a freezer-refrigerator using a GA-fuzzy theory as claimed in claim 5, wherein a mixed inference (TSK) method is applied to said GA-fuzzy theory as a fuzzy inference method.

7. A defrosting apparatus for a freezer-refrigerator using a GA-fuzzy theory as claimed in claim 6, wherein the genetic algorithm is applied for setting parameter of the premise of said mixed inference method.

8. A defrosting apparatus for a freezer-refrigerator using a GA-fuzzy theory as claimed in claim 5, wherein said actual environmental data includes the number of opening and shutting doors of the freezing room and cold-storage room per hour, outside temperature, operation rate of a compressor, and time periods during the doors of the freezing room and cold-storage room remain opened.

9. A defrosting apparatus for a freezer-refrigerator using a GA-fuzzy theory as claimed in claim 5, wherein said microcomputer comprises:

an input interface unit for controlling said actual environment data from said means for inputting;

a first random access memory RAM unit for storing data controlled by said input interface unit;

a programmable read only memory (PROM) unit for storing said reference learning data and an executive program;

a CPU for running the data and the program of said first RAM unit and said PROM unit to output optimal defrosting periods of the freezing room and cold-storage room, respectively.

a second RAM unit for storing the output data from said CPU for a while; and an output interface unit for controlling the data from said second RAM unit so as to be fitted to a specification of said means for controlling a defrosting heater.

10. A defrosting apparatus for a freezer-refrigerator using a GA-fuzzy theory as claimed in claim 9, wherein said reference learning data, a calculation program for obtaining frost-quantities on the evaporators of the freezing room and cold-storage room, and a GA-fuzzy inference program are stored in said PROM unit.

11. A defrosting apparatus for a freezer-refrigerator using a GA-fuzzy theory as claimed in claim 10, said CPU runs said calculation program stored in said PROM unit to obtain each frost-quantity of the freezing room and cold-storage room, and thereafter runs the GA-fuzzy inference program by using each frost-quantity as input variables.

* * * * *

UNITED STATES PATENT AND TRADEMARK OFFICE

CERTIFICATE OF CORRECTION

PATENT NO. : 5,673,565

DATED : October 7, 1997

INVENTOR(S) : Jeong et al.

Claim 1, Col. 6, line 43, "frost-quantifies" should read --frost- quantities--.

Signed and Sealed this

Fifth Day of May, 1998

*Attest:*

*Attesting Officer*

BRUCE LEHMAN

*Commissioner of Patents and Trademarks*